United States Patent [19]

Dicke et al.

[11] Patent Number: 4,865,288

[45] Date of Patent: Sep. 12, 1989

[54] DEFLECTABLE MOUNTING

[76] Inventors: Grant D. Dicke, 1130 Franklin St., Downers Grove, Ill. 60515; Jeffery A. Williams, 6723 Vale Dr., Apt. #2, Westmont, Ill. 60559

[21] Appl. No.: 200,718

[22] Filed: May 31, 1988

Related U.S. Application Data

[63] Continuation-in-part of Ser. No. 815,737, Jan. 2, 1986.

[51] Int. Cl.[4] ..... F16M 13/00

[52] U.S. Cl. ..... 248/576; 248/160; 248/170; 40/602; 40/608

[58] Field of Search ..... 248/599, 160, 575, 619, 248/596, 597, 576, 170; 40/602, 606, 608, 612; 403/120

[56] References Cited

U.S. PATENT DOCUMENTS

| | | | |
|---|---|---|---|
| 623,008 | 4/1899 | Greb et al. | 248/597 X |
| 1,532,865 | 4/1925 | Beck | 40/608 X |
| 1,750,118 | 3/1930 | Mueller et al. | 40/602 X |
| 2,802,291 | 8/1957 | Bach et al. | 40/606 X |
| 3,646,696 | 3/1972 | Sarkisian | 40/606 X |
| 3,662,482 | 5/1972 | Sarkisian | 40/606 X |
| 3,899,843 | 8/1975 | Doyle et al. | 40/602 |
| 4,033,536 | 7/1977 | Hillstrom | 248/160 |
| 4,038,769 | 8/1977 | Werner | 40/612 X |
| 4,137,662 | 2/1979 | Baumer | 40/608 X |
| 4,309,836 | 1/1982 | Knapp | 40/602 |
| 4,365,435 | 12/1982 | Snyder | 40/608 |

FOREIGN PATENT DOCUMENTS 1181967 6/1959 France .

*Primary Examiner*—Ramon S. Britts
*Assistant Examiner*—David M. Pubol
*Attorney, Agent, or Firm*—Keil & Weinkauf

[57] ABSTRACT

An upright mast is affixed to a horizontal supporting means which is pivotally mounted on a horizontal shaft seated in a mounting base whereby a horizontal resilient member, such as a spring, concentric with the shaft separately resists pivotal deflection in opposite directions of said upright member on its supporting base.

20 Claims, 1 Drawing Sheet

DEFLECTABLE MOUNTING

BACKGROUND OF THE INVENTION AND PRIOR ART

This application is a continuation-in-part of application Ser. No. 815,737, filed Jan. 2, 1986.

This invention relates to an improved novel mounting structure for a deflectable upright member affixed to a supporting base. More specifically, the invention relates to an improved novel mounting structure for an upright structure such as for an outdoor sign or barrier or other structure which permits deflection, without damage, of the sign barrier or structure by wind forces and the like.

There is often need along vehicle roadways and pedestrian pathways for signs and barriers to provide information and mark off limits. Frequently, the need is temporary and, thus, it is very advantageous to have mountings for such signs and barriers which may be readily assembled and disassembled; yet which will not be moved, disturbed, or overturned by wind and/or the weight of rain or snow, or by air currents generated by the movement of vehicles. Also, to some extent, it is advantageous that such signs and barriers be temporarily deflectable by a direct contact of vehicles and pedestrians and the like without permanent damage and that such signs can be adjusted back to the vertical when positioned on inclines or on uneven surfaces.

There have been a number of structures devised to permit signs and posters to be temporarily deflected by wind forces. One such structure is shown in the parent application Ser. No. 815,737, which requires 2 abutting resilient members and the horizontal support is in direct contact with the resilient members. Another structure is shown in the present assignee's copending case, Ser. No. 594,879, filed Mar. 29, 1984, wherein an upright mast is secured to a horizontal shaft which passes through the mast, and each end of 2 resilient means is attached through a collar to the outside of the mast and the other end of the resilient means is firmly secured to the base mounting. A structure is disclosed in U.S. Pat. No. 4,365,435, wherein a sign panel is pivotally mounted at its two sides close to the center of its load wherein there would be the least amount of force applied to its springs. A bar stool structure is disclosed in U.S. Pat. No. 623,008, which has nothing to do with a sign and does not resist deflection in opposite directions. A structure is shown in French Patent No. 1,181,967, wherein an essentially single mast signpost is supported on a pair of resilient and foldable base members. Two additional structures are as shown in U.S. Pat. No. 3,662,482, where a poster board is supported on two upright members: in one embodiment, the uprights are in turn supported on a torsion bar; and in the other embodiment a pair of flexible compression springs are substituted for the upright members. Also, U.S. Pat. No. 4,309,836 shows an adjustable flexible mast, for holding a sign, extending upwardly from a support frame.

However, except for the parent application and the present assignee's apparatus in co-pending Ser. No. 594,879, the prior structures have involved resilient members which must be able to react in each of two opposite directions thereby tending to overwork the resilient members and increase the likelihood of loss through fatigue or over-extension. Also, the prior structures do not provide for adjustment of the resilient members to allow compensation against mild prevailing wind forces or sloping terrain whereby the mast and sign may be adjusted to be upright in the best visible posture. That is to say, the prior art devices will be deflected to some extent by any given wind force and, therefore, if there is a constant breeze, the sign will be constantly deflected with loss of some visibility.

The present invention is an unexpected improvement over the prior art whereby in the present deflectable mounting, the entire load or pressures on the upright member or mast is applied simultaneously to a supporting means, such as a fender, and a pressure transfer member, such as a bar, rod, wedge or other member, which transfers and distributes these forces uniformly over the affected portion of the resilient means, such as a spring, riding on a shaft, such as a hollow tube with end sides riding on an axle.

OBJECTS AND SUMMARY OF THE INVENTION

Accordingly, it is an object of the present invention to provide an improved deflectable mounting for an upright member or mast, for example, for supporting a sign or barrier or the like, wherein a resilient member is provided for resisting deflection of the mast in respective opposite directions.

It is a further object of the present invention to provide an improved deflectable mounting for an upright member or mast whereby the load or force from the upright member or mast is transferred simultaneously through a support and a pressure transfer member to a resilient member.

It is another object of the present invention to provide an improved deflectable mounting for an upright member or mast, wherein there is an adjustment to maintain the upright member or mast vertical against a prevailing deflective force.

It is still another object of the present invention to provide an improved deflectable mounting for an upright member or mast, wherein a single resilient member is provided to resist deflective forces in opposite directions whereby outer end strands or lever arms of the resilient member are adjustably mounted so as to disengage through a portion of deflection in a direction opposite to that which the end strand or lever arm is intended to resist.

The present invention generally comprises an upright structure or mast intended for a vertical posture affixed to a supporting member pivotally mounted upon a mounting base and wherein a single spring is concentric with a shaft, the outer end strands or lever arms of the spring extend downwardly through openings in the base or shelf structure so that the spring end strands or lever arms are positioned on opposite sides of the pressure transfer bar or rod or wedge, attached to the supporting member, whereby one spring end strand or lever ar resists pivoting of the upright member or mast principally in one direction and the other spring end strand or lever arm resists pivoting of the upright member or mast principally in a direction opposite thereto.

BRIEF DESCRIPTION OF THE DRAWINGS

Further objects and advantages will become apparent upon reading the following detailed specification in conjunction with the drawings, wherein.

DETAILED DESCRIPTION

Figure 1:
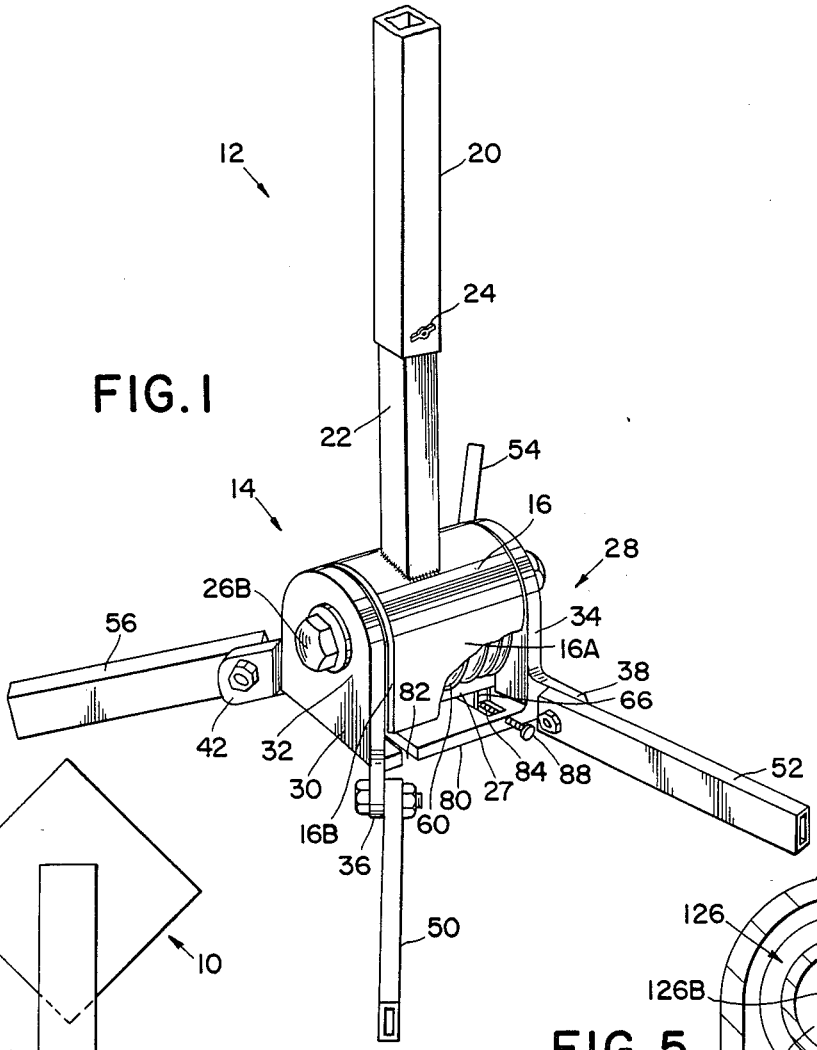
FIG. 1 is a perspective view of a preferred embodiment of the present invention.

A preferred embodiment of the invention shown in the figures comprises a visible member generally 10, such as a sign or barrier bar or the like, which is vertically supported upon a mounting base, preferably a foldable mounting base generally 28 (as seen in FIG. 1). It is desirable that the vertical height of the mast 12 be adjustable which can be accomplished by providing an upper mast portion 20 telescopically fitted to a lower mast portion 22 and a securing device 24, such as a set screw or the like, for releasably fastening the two portions 20 and 22 together.

Figure 2:
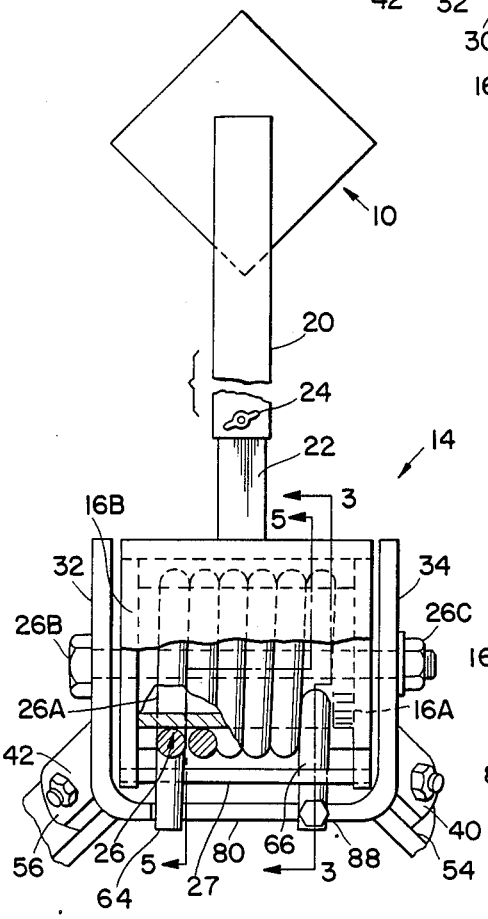
FIG. 2 is a front elevation of a portion of the apparatus shown in FIG. 1.
Figure 3:
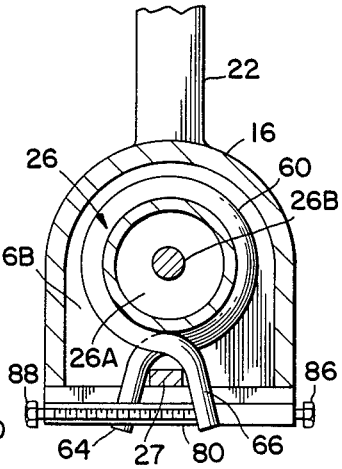
FIG. 3 is a partial vertical section view of the apparatus taken at line 3—3 in FIG. 2.

According to the present invention, the lower mast 22 (as seen in FIG. 1) is affixed, such as by welding 18, to supporting means, such as a semi-cylindrically or an arcuate shaped fender 16, which is mounted upon the mounting base generally 28 by a pivotable means, preferably a horizontal shaft 26 (as seen in FIG. 3), such as a hollow tube with end sides 26A seated on an axle such as a bolt 26B affixed with a nut 26C at the end of said mounting stand generally 28 (as seen in FIG. 2). The fender 16 comprises a horizontal support, generally a semi-cylindrically or an arcuate shaped section, having two oppositely situated end sides 16A and 16B, which sides are pivotally mounted on the shaft 26 and the axle, such as the bolt 26B, inwardly of said mounting stand generally 28. Pressure transfer bar or rod 27 is inwardly attached to end sides 16A and 16B below spring 60 and extends between spring end strands or lever arms 64 and 66. The mast 22 is firmly secured centrally to the fender 16 such as by welding 18 or other means. It will be seen in the drawings that the mounting stand 28 comprises a lower frame 30 having two oppositely situated upright members 32 and 34 in the upper ends of which the shaft 26 and axle, such as the bolt 26B, are seated. The mounting base 28 also has multiple (preferably four) leg flanges 36, 38, 40 and 42 extending from the corners of the lower frame 30; and an equal number of foldable and extendable legs 50, 52, 54 and 56 are pivotally mounted thereon.

The resilient means is located below the mast 22 and the supporting means, such as the fender 16 mounted on the mounting base 28, to urge the mast 22 in an upright position. This is preferably a coil spring 60 (as seen in FIG. 3), which is concentrically placed over the horizontal shaft 26. The fender 16 is partially concentric to said spring 60.

It is understood that the coil spring 60 of the preferred embodiment is of the type formed from elastic steel spring wire helically wound in cylindrical form and having outwardly extended radial ends for applying compression and tension forces to the helical coils. It is well known that in this type of spring tension forces, which tend to tighten the coils, are efficiently resisted by the spring and the ends will withstand a large degree of twist and tensioning movement without causing damage to the spring coils.

In the present invention, the coil spring 60 has two opposite end strands or lever arms 64 and 66 which extend downwardly on opposite sides of the pressure transfer bar or rod 27 to be in pivotable contact therewith.

Figure 4:
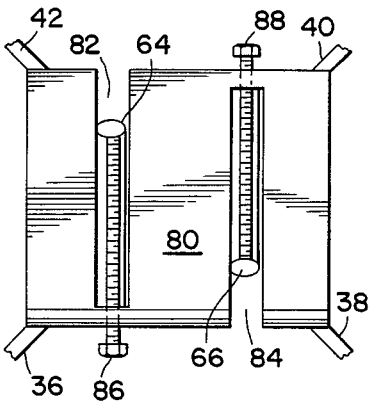
FIG. 4 is a bottom plan view.

The respective opposite end strands or lever arms 64 and 66 of spring 60 are received through the indented side openings 82 and 84 at opposite ends of the shelf 80 that bridges the mounting stand 28 a short distance below the horizontal shaft 26, spring 60 and pressure transfer bar or rod 27. The shelf 80 is firmly secured to the inner sides of upright members 32 and 34 of the mounting stand 28 such as by welding or the like. The outer spring end strands 64 and 66 descend into the indented outer side openings 82 and 84 of the shelf structure 80 below the pressure transfer bar or rod 27 and descend below the floor of the shelf 80 within the openings 82 and 84, wherein the respective end strands 64 and 66 may move in planes perpendicular to the shaft 26. The mast 22 may be pivoted several degrees on the supporting means, such as the fender 16, which pivots freely on shaft 26 in a given direction, before the respective end strand 64 or 66 becomes engaged by the adjustment bolts 86 or 88 in a compressive action to resist further deflection or pivoting. As the mast 22 pivots, pressure transfer bar or rod 27 engages end strand or lever arm 64 or 66 causing it to move in the opening 82 or 84 in the direction of the moving pressure transfer bar or rod 27, opposite to the pressure applied to the mast and opposite o the position of the adjustment bolt 86 or 88. The other respective end strand 64 or 66 will be engaged by the other adjustable bolt 86 or 88 in a tension action to resist movement thereof. As seen in FIG. 4, adjustment bolts 86 and 88 are preferably threaded through the opposite front and rear ends of the shelf 80 in line with the respective end strands 64 and 66, whereby the degree of free pivoting deflection of the mast 22 may be adjusted and the spring end strand engaged.

As may be seen in FIGS. 2 and 3, the spring end strands 64 and 66 normally extend downwardly from slightly off center of the spring and closer to its adjustment bolt in a near vertical direction when not under stress. Accordingly, by proper adjustment of each of the adjustment bolts 86 and 88, the mast 22 may be held vertical by the respective end strands 64 and 66 of the spring 60. However, by then tightening one and loosening the other bolts 86 and 88, the mast 22 and fender 16 may be pivoted slightly on shaft 26 in either of two directions. Such adjustment may be made while still providing several degrees of play between the respective end strands 64 and 66, within the openings 82 and 84. Thus, when the mast 22 is adjusted either vertically or slightly to either side thereof, the load or pressures applied against the mast 22 in one direction will be resisted immediately by the tension on the bar or rod 27 which is transferred and distributed uniformly to the spring end strands or lever arms 64 or 66. Reverse pressures in the opposite direction will result in the opposite spring end strand or lever arm 64 or 66 being tensioned immediately by bar or rod 27. It is seen that it is the pressure transfer bar or rod 27 in conjunction with fender 16 that actually operates the spring 60 by transferring and distributing the forces uniformly to the spring 60 through the bar or rod 27, positioned at fender side ends 16A and 16B, to the end strands or lever arms 64 and 66.

In this way, the mast 22 mounted on the fender 16 may be preadjusted to stand substantially vertical against a prevailing force, such as wind or on an incline which would otherwise constantly deflect the mast and any sign or visible display it carriers.

Figure 5:
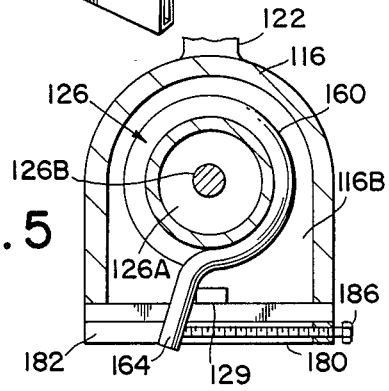
FIG. 5 is a partial vertical section view showing another preferred embodiment.

FIG. 5 is similar to FIG. 3, except that two wedges 129, only one is shown, replace the pressure transfer bar or rod 27. In this embodiment, each wedge 129 extends from the oppositely situated end sides of fender 116 to be in pivotable contact with the end strand or lever arm, such as end strand or lever arm 164 as shown. As the mast 122 pivots, one of the pressure transfer wedges 128 engages the end strand or lever arm, causing it to move in the opening, shown as opening 182, in the direction of the moving pressure transfer wedge 129, opposite to the pressure applied to the mast and opposite to the position of the adjustment bolt, such as adjustment bolt 186, as shown in shelf 180.

The present deflectable mounting presents a single resilient member, such as a spring, which operates in opposite directions. This results in a smaller unit capable of producing equivalent or greater amounts of work whereby the pressure transfer element uniformly transfers the force from the upright member to the spring lever arms.

While the preferred embodiment illustrated utilizes a coil spring in the form of cylinders of helically wound wire, it would also be possible to utilize spiral wound springs comprising elastic steel wire wound in a single plane (similar to a watch spring).

It will be apparent to those skilled in the art that still further modifications and changes may be made without departing from the scope of the invention which is defined in the following claims.

What is claimed is:

1. An improved deflectable mounting, said mounting comprising:

a substantial vertical means firmly affixed to horizontal supporting means;

a mounting base for supporting said supporting means and said vertical means; pivotable horizontal means connecting said supporting means and said mounting base to enable said vertical means and supporting means to be deflected in two opposite directions;

horizontal resilient means mounted about said pivotable means and beneath said supporting means for resisting deflection of said vertical means and supporting means principally in each of said directions;

pressure transfer means affixed to said supporting means and in pivotable contact with said resilient means; and adjustable mounting means for adjustably securing said resilient means to one of said supporting means and said mounting base whereby to allow for biasing adjustment of the vertical means to a vertical position against a deflecting force.

2. The apparatus of claim 1, wherein the pivotable horizontal means is a shaft seated in said mounting base and extending substantially horizontally beneath said supporting means.

3. The apparatus of claim 1, wherein said resilient means is a wound spring having outer end strands mounted so that each end of the spring can be alternately tensioned by deflection of the said vertical means, supporting means and pressure transfer means in said two opposite directions, respectively.

4. The apparatus of claim 2, wherein said resilient means is a wound spring having outer end strands mounted so that each end of the spring can be alternately tensioned by deflection of the said vertical means, supporting means and pressure transfer means in said two opposite directions, respectively.

5. The apparatus of claim 4, wherein said spring is helically wound and concentrically mounted on said shaft.

6. The apparatus of claim 5, wherein the adjustable mounting means loosely receives an outer end strand of the spring whereby to permit a portion of deflection of said vertical means, supporting means and pressure transfer means without compressing or tensioning the spring.

7. The apparatus of claim 6, wherein the adjustable means includes movable members to reduce or increase the amount of deflection by which the said spring ends will not be compressed or tensioned.

8. The apparatus of claim 7, wherein the mounting base comprises a shelf bridging said base and located below said spring and said pressure transfer means, and having indented front and rear sides at each outer end to receive the outer spring strands descending through said indented side openings.

9. The apparatus of claim 8, wherein the adjustable means comprises adjustable bolts extending through the opposite sides of said shelf into said indented shelf side openings into contact with said end strands of said spring.

10. The apparatus of claim 9, wherein said spring comprises radially downward extending end strands positioned on opposite sides of said transfer means and in pivotable contact therewith.

11. The apparatus of claim 10, wherein said supporting means comprises a semi-cylindrical or arcuate-shaped fender which is partially concentric to said spring and which has two opposite side ends extending downward from which said shaft extends and from which said pressure transfer means extends and whereby said fender and said pressure transfer means operate at the spring.

12. The apparatus according to claim 11, wherein said pressure transfer means comprises a bar or rod that extends horizontally connecting said side ends of the fender.

13. The apparatus according to claim 11, wherein said pressure transfer means comprises a first wedge attached to an inner wall of one of said side ends of the fender and a second wedge attached to the opposite side end inner wall of the fender, wherein each wedge being in pivotable contact with the inner side of the spring strand.

14. An improved deflectable mounting, said mounting comprising:

a normally vertical mast member firmly affixed to a supporting means comprising an arcuate shaped horizontal fender member with opposing sides extending downward;

a mounting base for supporting said mast member and supporting means, said mounting base having a plurality of foldable legs extendable therefrom to stabilize the deflectable mounting;

a normally horizontal pivotable shaft extending through the sides of said horizontal supporting means and through said mounting base whereby said mast and supporting means may deflect freely in two opposite directions;

a shelf bridging said mounting base, below said shaft, said shelf having an indented top side at each outer end thereof;

at least one bolt adjustably extending through opposite front end sides of said shelf into each of said indented side openings;

a horizontal wound spring mounted about said shaft and having at end strand on each end thereof, each end strand extending downward through said indented shelf opening;

a horizontal bar or rod connecting the inner sides of said fender and positioned between said end strands and in pivotable contact therewith;

whereby deflection of said mast in one direction will tension one end of said spring and deflection of said mast in the opposite direction will tension the opposite end of said spring, and the end strands of said spring will be alternately disengaged for a portion of the mast deflection when the tension is released and before each respective spring end is compressed; and whereby said arcuate shaped horizontal fender is partially concentric to said spring, and said fender and said bar or rod operate the spring.

15. The apparatus of claim 12, having an upper mast attached to said mast.

16. The apparatus of claim 14, having a panel attached to the upper mast.

17. The apparatus of claim 13, having an upper mast attached to said mast.

18. The apparatus of claim 17, having a panel attached to the upper mast.

19. The apparatus of claim 14, having an upper mast attached to said mast.

20. The apparatus of claim 19, having a panel attached to the upper mast.

* * * * *